US005592768A

United States Patent [19]

Testa

[11] Patent Number: 5,592,768

[45] Date of Patent: Jan. 14, 1997

[54] PHOTOGRAPH DISPLAY DEVICE

[76] Inventor: Richard J. Testa, 352 Lanning Rd., Honeoye Falls, N.Y. 14472

[21] Appl. No.: 349,907

[22] Filed: Dec. 6, 1994

[51] Int. Cl.[6] ..... G09F 1/00

[52] U.S. Cl. ..... 40/786; 40/539; 40/124.1

[58] Field of Search ..... 40/155, 124.1, 40/159, 160, 539, 489, 780, 786; D9/428, 418, 346, 329; 229/116.1, 906, 117.01

[56] References Cited

U.S. PATENT DOCUMENTS

| | | | |
|---|---|---|---|
| 2,428,772 | 10/1947 | Aranoff | 40/124.1 |
| 3,057,095 | 10/1962 | Foreman | 40/124.1 |
| 3,174,244 | 3/1965 | Walten | 40/124.1 |
| 3,767,105 | 10/1973 | Matsuyama | 229/155 |
| 3,929,222 | 12/1975 | Smith et al. | 229/113 X |
| 4,828,421 | 5/1989 | Arakaki . | |
| 4,991,767 | 2/1991 | Wyant . | |
| 5,031,935 | 7/1991 | D'Andrea . | |
| 5,096,752 | 3/1992 | Wagner . | |
| 5,238,345 | 8/1993 | D'Andrea . | |

FOREIGN PATENT DOCUMENTS

| | | | |
|---|---|---|---|
| 2054163 | 10/1972 | Germany | 40/124.1 |
| 183576 | 7/1922 | United Kingdom | 40/124.1 |
| 1364149 | 8/1974 | United Kingdom | 40/124.1 |

*Primary Examiner*—Kenneth J. Dorner
*Assistant Examiner*—Cassandra Davis
*Attorney, Agent, or Firm*—Eugene Stephens & Associates

[57] ABSTRACT

A photograph is held between two panels of a multi-panel display device and viewed through a die cut in an outer panel. The device is formed in such a way that when one or two flaps of one layer are folded toward the other layers, the two sets of layers assume opposite curvatures to provide support for the device. The flaps can be automatically pulled into position by a biasing apparatus. The outer panel can have graphics printed around the die cut in such a way as to give the appearance of interaction between the subject of the photograph and the scene depicted in the graphics. The die cut can be shaped and situated such that the face of a subject of the photograph appears in place of the face of a character depicted in the graphics. The die cut can also follow the outline of a character depicted in the graphics to preserve the integrity of the image while allowing display of the photograph.

29 Claims, 3 Drawing Sheets

PHOTOGRAPH DISPLAY DEVICE

BACKGROUND OF THE INVENTION

In the U.S. alone, over 18 billion pictures are taken annually. A few examples of the way people use photographs are to record inventories of their belongings, to record special events in their lives (such as weddings, holidays, birthdays, etc.), and to record travel experiences. As a result of the number of pictures taken annually, there is considerable demand for such items as photo frames, photo albums, and other photo related products.

The display device of the instant invention provides users with a collapsible, compact, and convenient way to display their photos. The display device of the invention also provides the opportunity to enhance the display of the user's photographs. The subject(s) of the photographs contained in the display device appears to be part of a specific event, locale, or story depicted on the device. This allows users to have more personalized recollections of the event or locale. For example, the display device can depict a scene from a motion picture, a theme park, a stylized event with favorite fictional or non-fictional characters, or many other scenarios.

Photo display devices are found in the prior art which are related to the invention to some extent. See for example U.S. Pat. No. 4,828,421 to Arakaki. Arakaki discloses a personalized photo album that has a specialized recess in each of its front and back covers. The owner can insert personal indicia, such as a photograph, in each recess to clearly associate the album with him- or herself. This is the extent of the personalization of the photo album and does not give the appearance of photo subject interaction with scenes depicted on the album's pages as does the instant invention. Further, the photo displayed is left flat when on display and the album does not allow for easy, stand-alone display of a photograph.

In U.S. Pat. No. 4,991,767, Wyant discloses a portfolio with a cover that can display selected photographs. The cover of this portfolio has a transparent film over it. The user places photographs between the film and the cover such that the photographs are visible through die cuts in the cover when the cover is closed. Wyant does not disclose the inclusion of graphics to give the appearance of interaction between the subjects of the photos and the scenes depicted in the graphics. As with the Arakaki patent above, the photo is displayed flat and the portfolio does not allow for easy, stand-alone display of a photograph.

D'Andrea discloses a specialized book in U.S. Pat. No. 5,031,935. The book includes superimposed die cuts in its pages, as well as a cover that provides a recessed area for a mirror or display of photographs on its outer surface. A user places a photograph on the inside front and/or back covers such that the photograph is visible through the die cuts. The die cuts are cut through the entire thickness of each page. The die cuts can be placed to give the appearance of limited interaction between the subject of the photograph and the scenes depicted in the book. The scenes in the book are portrayed by drawings, such as line drawings or the like. While these illustrations do suggest limited interaction with the scenes they depict, they do not provide the realism photographic or photo-realistic images would. Further, the photos are displayed flat and the book does not allow for easy, stand-alone display of a photograph.

In U.S. Pat. No. 5,096,752, Wagner discloses a place mat that provides for the display of a card. The place mat has a transparent front panel through which photographs and/or card inserts selected by the user can be viewed. The card inserts can display graphics related to the photos displayed. The appearance of interaction or involvement of the subjects of the photos and cards is not contemplated. The photos displayed are displayed flat, and the mat must either lie flat on a surface or be hung on a wall.

In a later patent to D'Andrea, U.S. Pat. No. 5,238,345, a method of making a publication is disclosed. The publication, such as a book, contemplated is geared specifically toward association with team sports and provides for the display of a photograph in such a format that it appears that the subject of the photograph is part of a scene depicted in the book. The scene is typically an artist's rendering of a portion of a game played by a particular team. As in her earlier book, D'Andrea uses superimposed die cuts in the pages of the book. A photograph is placed on the inside back cover. The die cuts are situated so that the photograph can be seen therethrough. Graphics are placed around the die cuts so that it appears that the subject of the photograph is part of the scene(s) depicted.

The book disclosed in the second D'Andrea patent has many of the same disadvantages as the first. The illustrations are drawings as in the books of the first patent and do not give the realism that photographic or photo-realistic images would. The photo displayed is displayed flat and the book does not provide for easy, stand-alone display of a photograph.

Typical stand-up photo frames share some of the disadvantages of the above prior art. They almost universally provide only for the flat display of photographs. The folding leg typically supporting these frames is not always reliable and is frequently difficult to use. Few, if any, of these frames provide a support which sets itself up.

None of the prior art photograph display devices include instructions for taking a photograph that will yield an image optimally sized for use in an associated display device. This could often result in the improper or inadequate display of the photo. The user may also resort to taking a number of photos on a hit-or-miss basis until an appropriately sized photo is obtained, resulting in increased costs to the user. Additionally, sample images giving examples of photo composition and image size are not provided in the prior art. Users who have little knowledge of good photograph composition would thus have little chance of taking a photograph that is composed appropriately.

SUMMARY OF THE INVENTION

The invention is a photograph display device in the form of a collapsible frame. The device is made from a single piece of relatively foldable material, such as card stock, and has several panels. A photograph is inserted between two of the panels, one of which has a die cut to allow the photo to be seen therethrough. The panel which has the die cut also has graphics printed on an outer surface, the graphics depicting a scene related to the background of the photograph. A third panel has two curved creases which allow portions of that panel to be folded perpendicular to the rest of the layer. Folding the panel portions pushes against the other two panels, forcing the third panel and the other two panels into oppositely curved shapes, yielding a frame that stands up by itself for displaying the photograph held between the first two panels. To make it easier for the user to set up the device, a piece of resilient material can be attached to the curved parts, pulling them into position. The graphics and the background of the photograph can be matched to allow the appearance of interaction between the subject of the photograph and the scene or characters depicted in the graphics.

DETAILED DESCRIPTION OF THE PREFERRED EMBODIMENT

Figure 1:
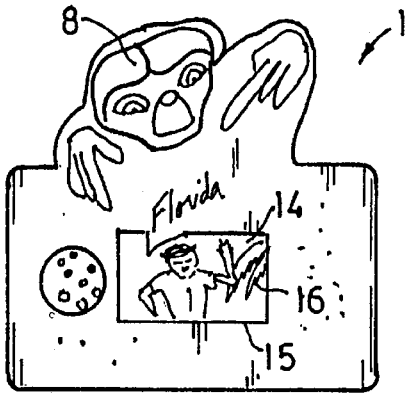
FIG. 1 is a front view of the invention in a collapsed state.
Figure 2:
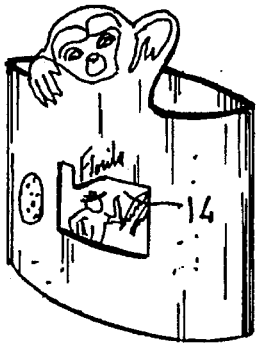
FIG. 2 is a view of the invention in an open state.
Figure 3:
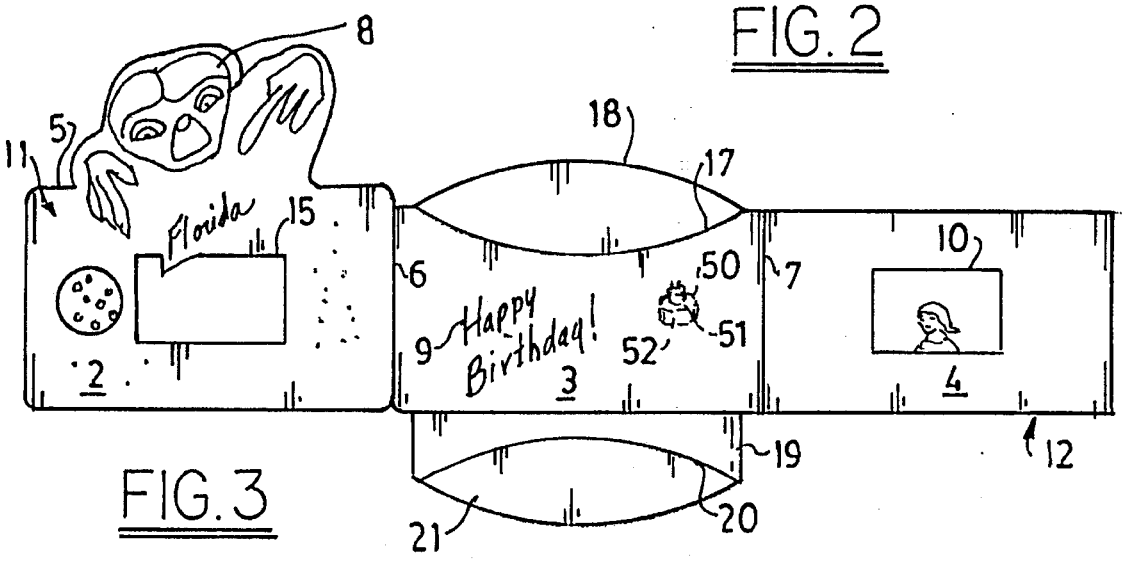
FIG. 3 is a view of the invention prior to assembly.
Figure 4:
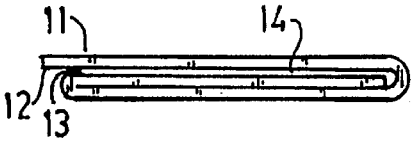
FIG. 4 is a side view of the invention illustrating the laminar nature of the invention.
Figure 5:
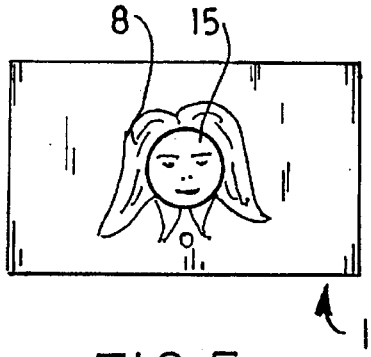
FIG. 5 is a view of the invention illustrating the substitution of the face of a photo subject for the face of a graphics character.
Figure 6:
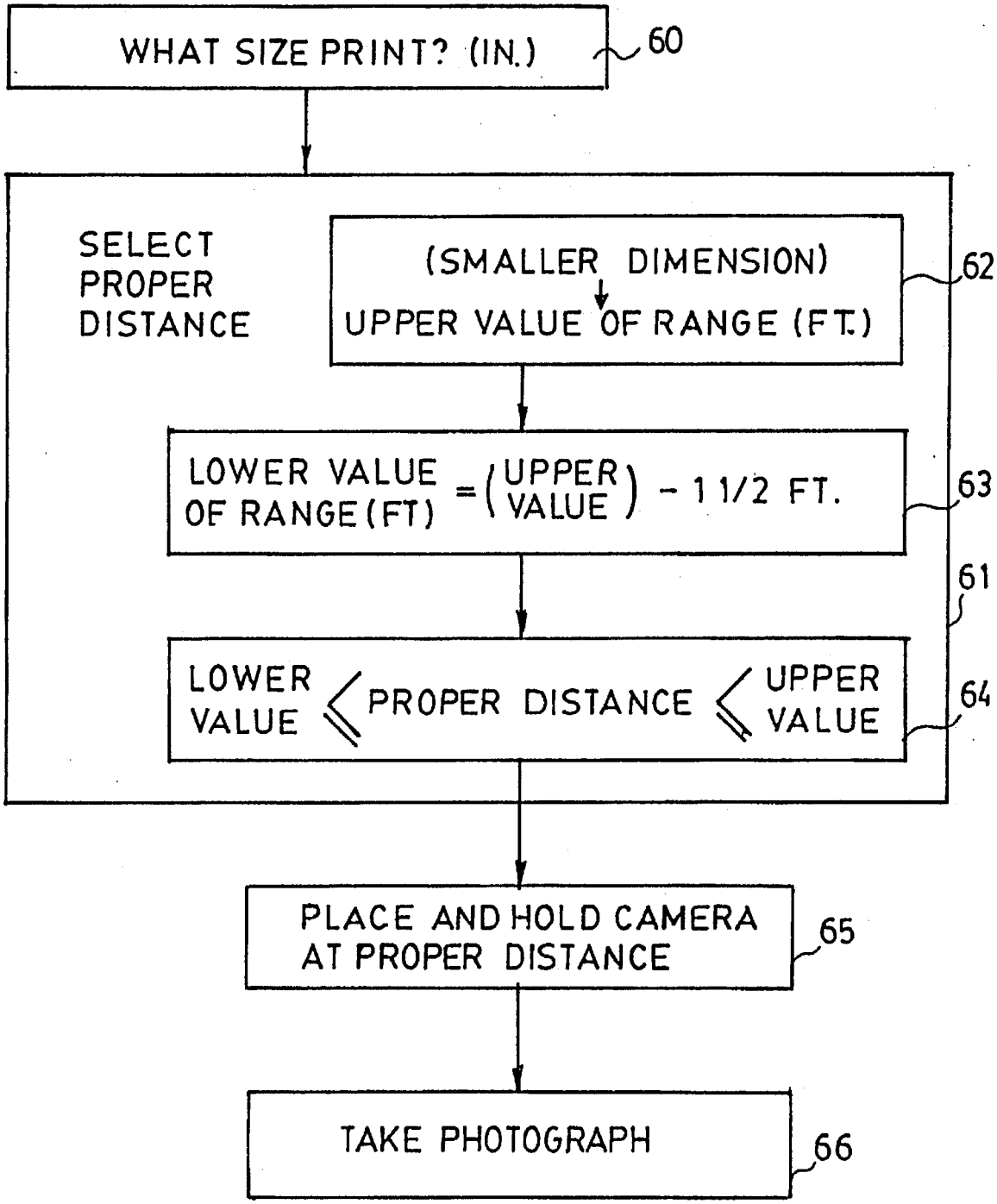
FIG. 6 is a flow chart illustrating a method of photography associated with the invention.

The following description of the invention is provided for illustrative purposes only. It is not the intent of the inventor to limit the invention to the particular examples described below.

As seen in the Figures, the display device 1 has three panels 2, 3, 4 formed from a single piece of material 5, such as card stock. The panels are created by first and second parallel creases 6, 7. First and second graphics 8, 9 can be printed on the first and second panels 2, 3, respectively, on a top surface 11 of the piece of material. This top surface 11 also makes up the outer surfaces of the first and second panels 2, 3 and can be coated to enhance adhesion of ink. The piece of material 5 can also be shaped so that it follows the outline of something depicted in the graphics, such as a character. Third graphics 10 can be printed on the third panel 4 on the top surface 11 of the piece of material 5 as well. The third panel 4 is folded against the bottom surface 12 of the piece of material 5 within the dimensions of the second panel 3. The first panel 2 is folded against the third panel 4 to form the completed display device 1. The third panel 4 is affixed to the first panel 2 by adhesive 13 or the like placed along the second crease 7 and an edge of the third panel 4 substantially parallel to the second crease 7. A photograph 14 can then be inserted between the third and first panels 4, 2 via an opening left along one of the other edges of the third panel 4.

A die cut 15 is provided through the first panel 2 to allow the third graphics 10 or the photograph 14 to be viewed. The first graphics 8, preferably a photographic or photo-realistic image, and the shape of the die cut 15 on the first panel can be chosen such that a subject of the photograph 14 appears to be interacting with a scene or characters depicted in the graphics. The die cut 15 can also be shaped and positioned such that the face of a subject of the photograph 14 appears in place of the face of a character depicted in the graphics. Another option is to have the die cut 15 follow the outline of a character depicted in the first graphics 8 such that the photo 14 can be displayed without affecting the integrity of the character's image. The first graphics 8 can be related in some way to the background 16 of the photograph 14. Additionally, the background 16 of the photograph 14 can be a predetermined background which matches and blends into the first graphics 8, enhancing the appearance of interaction between the subject of the photo 14 and the scene or characters depicted in the first graphics 8. The third graphics 10 can include a sample photographic image to aid in the proper positioning and composition of a photograph for display in the device 1.

If the background 16 is to match the first graphics 8, at least two types of background are contemplated. One type of background is a poster or other large display set up behind the subject and showing substantially the same scene as found in the first graphics 8 of the display device 1. The subject would then stand in front of the background while the photo was taken. The other type of background is a digitized image of the first graphics 8 which is manipulated using digital image processing equipment such that the image of the subject is superimposed on the background. For example, a microcomputer running ADOBE™ PHOTOSHOP™ could be used to superimpose the digitized images of the first graphics 8 and the subject of the photograph 14.

In addition to the second graphics 9, the second panel 3 has a first arcuate crease 17 which allows a curved portion 18 of the third panel 4 to be folded toward the first and third panels. When the curved portion 18 of the second panel 3 is folded perpendicular to the second panel 3 and toward the first panel 2, it forces the second panel 3 and the other two panels 3, 4 to assume opposite curvatures. The second panel 2 can additionally carry a flap 19 folded between the second and third panels 3,4. The flap 19 has a second arcuate crease 20 substantially parallel to the first arcuate crease 17 which allows a curved portion 21 of the flap to be folded away from the second panel 3 toward the other two panels 2, 4. When the curved portion 21 of the flap 19 and the curved portion 18 of the second panel 3 are perpendicular to the second panel 3, they force the second panel 3 and the other two panels 2, 4 to assume opposite curvatures as when the curved portion 18 of the second panel 3 is folded alone. The effect of the curved portion 21 of the flap is to provide extra support for the curvatures of the panels. This results in a display device 1, which stands up by itself and which gives the photograph 14 an attractive curved effect. The display device 1 can accommodate many different sizes of photographs, such as wallets, 3½"×5", 4"×6", etc.

Figure 7:
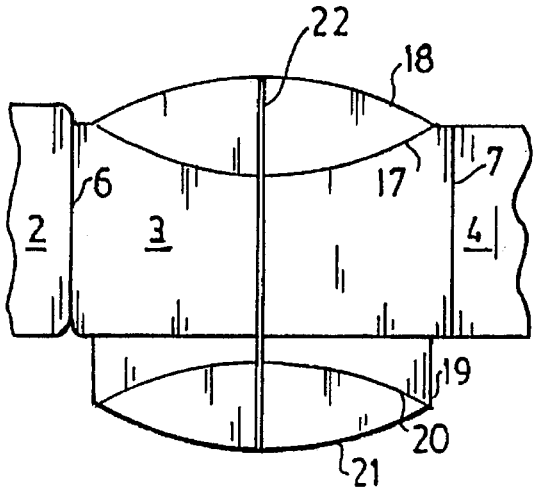
FIG. 7 is a view of the back of the invention showing the bias for the flaps.
Figure 8:
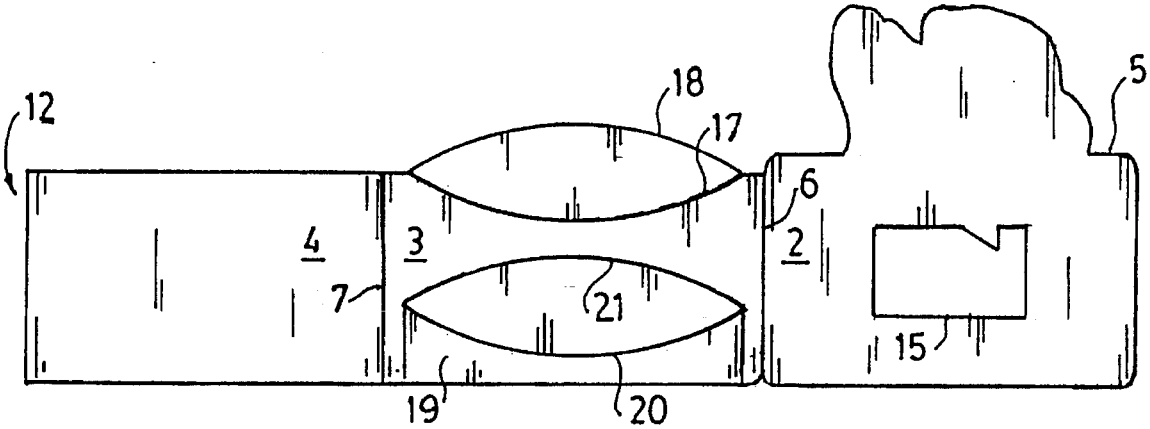
FIG. 8 is a view of the embodiment of FIG. 3 showing the invention is an intermediate stage whereby a flap is folded against the middle or second panel.
Figure 9:
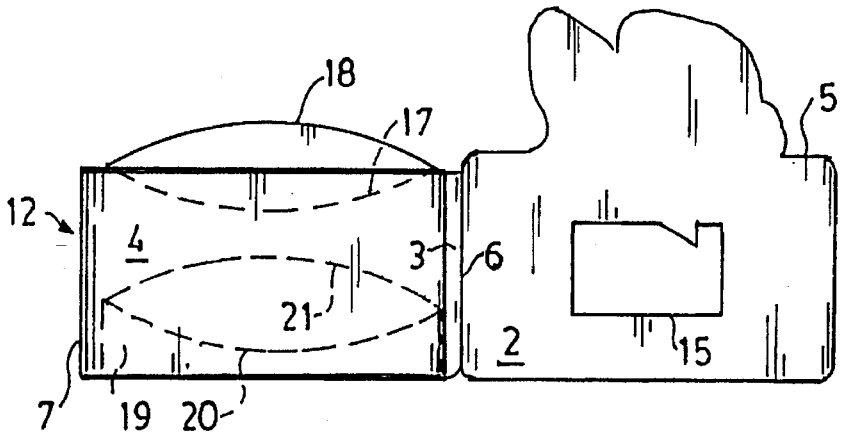
FIG. 9 is a view of the embodiment of FIGS. 3 and 8 showing the invention with the flap folded between the second and third panel.

The display device 1 can also include an apparatus that biases the device 1 into an open position. The apparatus can include a piece of resilient material 22, such as elastic, which can, for example, be attached to one or both curved portions 18, 21. An illustration of this is shown in FIG. 7, where the piece of resilient material 22 is shown stretching between the curved portion 21 of the flap 19 and the curved portion 18 of the second panel 3. The resilient material 22 biases the curved portions 18, 21 so that they tend to pop the display device into an open position. This makes it much easier for a user to open the device 1 to display the photograph 14 contained therein.

The advantage of the invention is that a user can insert a photograph into the display device 1, complete the greeting on the second panel, and mail the whole assembly to someone as a greeting card. When the addressee receives the device 1, he or she can pop the device 1 into its display configuration using the curved portions of the second panel and its flap. The display device 1 is then ready to be placed on any suitable surface the addressee desires for display of the photograph it contains.

The display device 1 can additionally use an audio signal storage and playback device 50, such as a voice chip, for storing and reproducing an audio input signal. The chip 50 can be used to record the voice of a user and/or music, or to store a pre-recorded audio signal, to be played back when the display device is used. A switch can be attached to the chip 50 such that when the display device is opened, the chip 50 plays its stored audio signal. Alternatively, the chip 50 can be placed in a piece of material 51, such as plastic; and playback can be triggered by exerting pressure on a switch 52 or the like by pressing the material. For example, the chip 50 can store a sound clip from a well-known movie and be embedded in a plastic likeness of a character from the movie. Depressing a part of the plastic likeness, the head for example, can cause the chip 50 to play the sound clip. The piece of material 51 need not include an audio signal storage and playback device. Instead, the piece of material 51 can be included to enhance the effect of a scene depicted in the display device 1.

A method of taking a photograph can be included with the framer of the invention. This method ensures proper image size in photographs in which the faces of the subjects will be substituted for the faces of characters depicted in the graphics of the display device. As a result of the use of this method, the user is required to make fewer attempts at getting the right image size. The user benefits by a reduction of time, energy, and cost expended in his or her attempts to achieve the proper image size. This is a distinct advantage over the prior art since no such method is provided with any other prior art display device.

In the first step of the method, the user must determine the lens and film size of the camera to be used. Then, the user must decide what size print will be displayed in the display device (Block 60). Next, the user must select from a range of distances the proper distance between the camera and the subject of the photograph (Block 61) based on the dimensions of the photograph. The following description of the step of selecting the proper distance (comprising Blocks 62 through 64) illustrates the method as applicable to a 35 millimeter camera using a 35 millimeter lens. The particularities of the method will vary for different lens and film sizes, and this description is not intended to limit the method to these examples. The magnitude of the lower dimension of the photograph is the maximum allowable distance (upper value of the range) in feet between the camera and the subject (Block 62). Next the user takes the upper value of the range in feet and subtracts 1½ feet (Block 63) to determine the minimum allowable distance (lower value of the range) in feet between the camera and the subject. For example, if the camera uses 35 millimeter film, has a 35 millimeter lens, and the print size is to be 3½ inches by 5 inches, the photographer must stand 2 to 3½ feet away from the subject. If the print size is to be 4 inches by 6 inches, using the same lens and film size, the photographer must stand 2½ to 4 feet away from the subject. The user then selects a proper distance from the range (Block 64), holds the camera at the proper distance (Block 65), and takes the photograph (Block 66). In a preferred embodiment, the user repeats the steps in Blocks 64–66, starting with the proper distance being the lower value and incrementing by 6 inches in each iteration until the highest value is reached. In other words, the user takes photos at 6-inch intervals within the range of distances determined, including the end values of the range.

I claim:

1. A photograph display device comprising:

a piece of a first material having a top surface and a bottom surface;

at least two substantially parallel creases separating the piece of first material into at least three panels, a third panel of the at least three panels folding over a second panel of the at least three panels and a first panel of the at least three panels folding over the third panel;

a die cut in the first panel adapted to display a photograph selectively held between the first and third panels; and a first arcuate crease on the second panel, the first arcuate crease delineating a selectively foldable curved portion of the third panel which, when folded substantially perpendicular to the third panel and toward the first panel, bears against the first panel and forces the first and second panels to assume opposite curvatures.

2. The display device of claim 1 further comprising:

first graphics on the top surface of the piece of material on the first panel.

3. The display device of claim 2 wherein the die cut follows an outline of a character depicted in the first graphics.

4. The display device of claim 2 wherein the first graphics and the die cut are arranged such that a subject of a displayed photograph appears to be involved in a scene depicted in the first graphics.

5. The display device of claim 4 wherein a character appears in the first graphics and the die cut is adapted to display a photograph such that a face of a subject of the photograph appears in place of a face of the character.

6. The display device of claim 2 further comprising:

second graphics on the top surface of the piece of material on the second panel.

7. The display device of claim 6 further comprising:

third graphics on the top surface of the piece of material on the third panel, the third graphics being visible through the die cut and including a sample image for demonstrating composition and position of a photograph for optimum display.

8. The display device of claim 7 wherein at least one of the first, second, and third graphics includes photographic images.

9. The display device of claim 7 wherein at least one of the first, second, and third graphics includes photo-realistic images.

10. The display device of claim 7 wherein at least one of the first, second, and third graphics includes line art.

11. The display device of claim 1 wherein a biasing apparatus biases the first and second panels toward assuming opposite curvatures.

12. The display device of claim 1 further comprising:

a flap on said second panel folded between the second panel and the third panel; and a second arcuate crease on the flap of the second panel substantially parallel to the first crease, the second crease delineating a selectively foldable curved portion of the flap which, when folded substantially perpendicular to the third panel and toward the first panel, bears against the first panel and, in conjunction with the selectively foldable portion of the second panel, forces the first and second panels to assume opposite curvatures.

13. The display device of claim 12 further comprising:

a biasing apparatus which biases the first and second panels toward assuming opposite curvatures.

14. The display device of claim 1 wherein a shape of at least one panel follows an outline of a character depicted on the at least one panel.

15. The display device of claim 1 wherein the second panel includes a message conveyance apparatus.

16. The display device of claim 15 wherein the message conveyance apparatus includes:

first graphics on the top surface of the piece of first material on the first panel; and a piece of a second material affixed to the piece of first material.

17. The display device of claim 16 wherein the message conveyance apparatus further includes:

audio signal storage and reproduction apparatus affixed to the piece of second material and including a switch inducing playback of the stored audio signal when operated.

18. The display device of claim 1 wherein a film is affixed over the die cut to protect the photograph from damage.

19. A photograph display device comprising:

a die cut in a first layer of a first material;

a second layer of first material affixed to the first layer of first material;

a third layer of first material affixed to the second layer of first material for concealing at least a portion of a surface of the second layer of first material, the third layer and first layer being adapted to hold a photograph such that at least a portion of a photograph can be seen through the die cut; and a support structure for supporting the display device comprising:

a first arcuate crease; and a first curved portion of the third layer defined by the arcuate crease, the first curved portion being selectively foldable toward the first and second layers, forcing the third layer and the first and second layers into opposite curvatures to support the device.

20. The display device of claim 19 wherein first graphics appear on an external surface of the first layer.

21. The display device of claim 20 wherein the first graphics include a character and the die cut is adapted to display a photograph such that a face of a subject of the photograph appears in place of a face of the character.

22. The display device of claim 19 wherein the support structure further comprises:

a flap attached to the third layer;

a second arcuate crease substantially parallel to the first arcuate crease; and a second curved portion of the flap, the second curved portion being defined by the second arcuate crease, the second curved portion being selectively foldable toward the first and second layers, forcing the third layer and the first and second layers into opposite curvatures in conjunction with the first curved portion.

23. A photograph display device comprising:

at least three pieces of material selectively arranged in layers;

at least a first of the at least three pieces of material having a die cut;

at least one of the at least three pieces of material having a curved portion thereon defined by an arcuate crease, the curved portion being selectively foldable toward at least one other of the at least three pieces of material such that the curved portion selectively forces the at least one of the at least three pieces of material and the at least one other or the at least three pieces of material to assume opposite curvatures; and the device being adapted to hold a photograph between two of the at least three pieces of material such that at least a portion of the photograph can be seen through the die cut.

24. The display device of claim 23 wherein the curved portion is formed on a flap attached to the at least one of the at least three pieces of material.

25. The display device of claim 23 wherein another curved portion is formed on one of the at least three pieces of material, the another curved portion being defined by another arcuate crease and being selectively foldable such that the another curved portion further forces the at least one of the at least three pieces of material and the at least one other of the at least three pieces of material to assume opposite curvatures when the another curved portion is folded over perpendicular to the one of the at least three pieces of material on which the another curved portion is formed.

26. The display device of claim 25 wherein the curved portion and the another curved portion are formed on the at least one of the at least three pieces of material.

27. The display device of claim 26 wherein the another curved portion is formed on a flap attached to the at least one of the at least three pieces of material.

28. The display device of claim 25 wherein the curved portion and the another curved portion are formed on respective pieces of the at least three pieces of material.

29. The display device of claim 28 wherein at least one of the curved portion and the another curved portion is formed on a flap attached to the piece of material to which the at least one of the curved portion and the another curved portion is attached.

* * * * *